US005750473A

United States Patent [19]

Shen

[11] Patent Number: 5,750,473

[45] Date of Patent: May 12, 1998

[54] PLANAR HIGH TEMPERATURE SUPERCONDUCTOR FILTERS WITH BACKSIDE COUPLING

[75] Inventor: Zhi-Yuan Shen, Wilmington, Del.

[73] Assignee: E. I. du Pont de Nemours and Company, Wilmington, Del.

[21] Appl. No.: 438,827

[22] Filed: May 11, 1995

[51] Int. Cl.[6] ..... H01P 1/203; H01B 12/02

[52] U.S. Cl. ..... 505/210; 505/700; 505/701; 505/866; 333/99 S; 333/204

[58] Field of Search ..... 333/99 S, 204, 333/205, 219; 505/210, 700, 701, 866

[56] References Cited

U.S. PATENT DOCUMENTS

| | | | |
|---|---|---|---|
| 4,963,843 | 10/1990 | Peckham | 333/204 X |
| 5,136,268 | 8/1992 | Fiedziuszko et al. | 505/866 X |
| 5,172,084 | 12/1992 | Fiedziuszko et al. | 505/866 X |
| 5,448,209 | 9/1995 | Hirai et al. | 333/204 |

FOREIGN PATENT DOCUMENTS

| | | | |
|---|---|---|---|
| 30403 | 2/1987 | Japan | 333/204 |
| 5308202 | 11/1993 | Japan | 333/204 |
| 6021703 | 1/1994 | Japan | 333/204 |
| 1525777 | 11/1989 | U.S.S.R. | 333/204 |

OTHER PUBLICATIONS

Curtis, J.A. et al, *IEEE MTT-S International Microwave Symposium Digest, vol. II*, 443–446 (1991).

Curtis, J.A. et al, *Applied Microwave*, pp. 86–93 (Fall 1991).

*Primary Examiner*—Benny T. Lee

[57] ABSTRACT

An improved high temperature superconducting planar filter wherein the coupling circuit or connecting network is located, in whole or in part, on the side of the substrate opposite the resonators and enables higher power handling capability.

10 Claims, 12 Drawing Sheets

PLANAR HIGH TEMPERATURE SUPERCONDUCTOR FILTERS WITH BACKSIDE COUPLING

FUNDING

The present invention was funded in part by the National Aeronautics and Space Administration (NASA) of the United States Government, which has certain rights in the invention.

FIELD OF THE INVENTION

This invention relates to an improved high temperature superconducting planar filter having a coupling circuit which enables higher power handling capability, less strict manufacturing tolerance requirements and ease of design and fabrication.

BACKGROUND OF THE INVENTION

Filters made of high temperature superconductors have narrow bandwidth, extremely low in-band loss, high off-band rejection, and sharp skirts, which have many applications in telecommunication, instrumentation, radar and electronic warfare systems. However, for certain applications requiring radiofrequency high power such as in transmitters, the high temperature super-conductor filters must handle high power ranging from watts to kilowatts. The power handling capability of high temperature superconductor filters is limited by the maximum current density in the filter circuit, which must be below the critical current density, $J_c$ of the high temperature superconductor material used for fabricating the circuit.

FIG. 1 shows a conventional 3-pole planar high temperature superconductor filter of the prior art, as described in Applied Microwave Magazine, Fall 1991, pages 86–93. The filter comprises a substrate 1 having a high temperature superconductor ground plane 2 disposed on one side thereof (i.e., the "back" side) and a patterned high temperature superconductor thin film layer disposed on the other side (i.e., the "front" side), as shown in FIG. 1(*c*) The entire back side of 1 is coated with high temperature superconductor thin film 2 as shown in FIG. 1(*b*) serving as a ground plane. The front side shown in FIG. 1(*a*) consists of three square shaped high temperature superconductor thin film patterns, 3*a*, 3*b*, and 3*c*, serving as resonators and four thin film high temperature superconductor transmission lines, 4*a*, 4*b*, 4*c*, and 4*d*, serving as coupling apparatus, in which 4*a* and 4*d* are for coupling to the input and output, respectively, and 4*b* and 4*c* are for inter-sectional coupling. There are two places in a high temperature superconductor filter likely to have high current concentration: One is in the resonators where the resonant standing wave has current peaks and the other is in the coupling apparatus and its vicinity, where the radiofrequency power is coupled into or out of the resonators.

FIG. 2 shows a conventional prior art 2-pole dual mode high temperature superconductor filter with coupling on the front side of the substrate, as described in Applied Microwave Magazine, Fall 1991, pages 86–93. The substrate 10 has high temperature superconductor thin films 11 and 12 deposited on both sides as shown in the cross sectional view of FIG. 2(*e*). The entire back-side of substrate is coated with high temperature superconductor thin film 11 serving as a ground plane as shown in FIG. 2(*d*). On the front side of the substrate 10 are high temperature superconductor thin film cut-corner squares 12 shown in FIG. 2(*a*), FIG. 2(*b*), and FIG. 2(*c*) which serve as a dual mode resonator with two modes coupled by the cut-corner 19. Three ways are known in the art for coupling on the front side of the substrate: FIG. 2(*a*) shows direct connected coupling, in which the high temperature superconductor input and output transmission lines 13 and 13*a* are directly connected to the resonator 12 at connecting points 14 and 14*a*, respectively. FIG. 2(*b*) shows gap coupling, in which the branch lines 15 and 15*a* are an extension of the input and output transmission lines 13 and 13*a* respectively, and are coupled to the resonator 12 by gaps 16 and 16*a* respectively. FIG. 2(*c*) shows parallel coupling, in which the high temperature superconductor input and output transmission lines 13 and 13*a* are extended to an additional length of 17 and 17*a* parallel to the edges of resonator 12 with gaps 18 and 18*a*, respectively to provide the coupling. All of these front side couplings have power handling capability problems: (1) The high temperature superconductor microstrip transmission line 13 shown in FIG. 2(*a*), FIG. 2(*b*) and FIG. 2(*c*) on a typical 0.5 mm thick $LaAlO_3$ substrate has a narrow line width on the order of 160 micrometers, and a strip line version has an even smaller line width. The narrow high temperature superconductor line has a limited power handling capability. In most filter designs, the input and output require a very strong coupling. The direct coupling shown in FIG. 2(*a*) can provide a strong coupling, but the radiofrequency current is strongly concentrated at the connecting points 14, 14*a* and their vicinity, which limits the power handling capability. In the case of gap coupling and of parallel coupling as shown in FIG. 2(*b*) and FIG. 2(*c*), the only way to provide strong coupling is to reduce the gap width which can result in arcing at even fairly low voltages. The typical gap width for input and output coupling is on the order of micro-meters, which again causes radio-frequency current concentration at the gap edges resulting in poor power handling. In addition, the extremely narrow gap requires a very strict manufacturing tolerance, which causes difficulties in design and fabrication. In summary, all the conventional front-side coupling mechanisms of the prior art have power handling problems for high temperature superconductor filters.

The present invention solves the above problems by providing an improved filter utilizing coupling on the back side of the substrate. It provides the additional advantages of higher power capibility, needing less strict manufacturing tolerances, easier design and fabrication and the absence of arcing when gap coupling or parallel coupling are employed.

SUMMARY OF THE INVENTION

The present invention comprises an improved high temperature superconducting planar filter of the type having a) a substrate having a front side and a back side, b) at least two resonators, each comprising a patterned high temperature superconductor film deposited on the front side of the substrate, c) a ground plane comprising an high temperature superconductor film deposited on the back side of the substrate, and d) a coupling circuit comprising an input line coupled to one resonator, an output line coupled to the second resonator, and interconnecting lines coupling between resonators, wherein the improvement comprises a coupling circuit which is positioned at least partially on the back side of the substrate.

In particular, the present invention comprises a filter wherein the coupling circuit comprises a) a first branched high temperature superconductor transmission line in coplanar line form connected to the input line, b) a second branched high temperature superconductor transmission line in coplanar line form connected to the output line, and c) an interconnecting high temperature superconductor transmission line in coplanar line form between every two resonators, wherein i) at least one of the said transmission lines is located on the back side of the substrate, ii) a discontinuity exists in the high temperature superconductor film of the ground plane around a perimeter of each transmission line which is located on the back side of the substrate, and iii) electromagnetic fields of said coupling circuit and said resonator overlap by positioning said discontinuity adjacent to or overlapping with a projection onto the back side of the substrate of an outer edge of said resonator.

BRIEF DESCRIPTION OF THE DRAWINGS

FIG. 1(*a*) shows the front view of the high temperature superconductor filter circuit. FIG. 1(*b*) shows the back view of the high temperature superconductor filter circuit. FIG. 1(*c*) shows the cross sectional view of the circuit in a microstrip line version.

FIG. 2(*a*) shows a front view having direct coupling. FIG. 2(*b*) shows a front view having gap coupling. FIG. 2(*c*) shows a front view having parallel coupling. FIG. 2(*d*) shows the back view of these three circuits. FIG. 2(*e*) shows the cross sectional view of these three circuits in a microstrip version.

FIG. 3(*a*) shows the front view of the invented filter circuit with three square shaped high temperature superconductor resonators. FIG. 3(*b*) shows the back view of the invented filter circuit with back-side coupling circuits and projections (dashed lines) of the edges of the resonators on the front side. FIG. 3(*c*) shows the cross sectional view of the circuit in a microstrip version.

FIG. 4(*a*) shows the front view of the invented filter circuit with a cut-corner square shaped high temperature superconductor resonator. FIG. 4(*b*) shows the back view of the invented filter circuit with back-side coupling circuits and a projection (dashed line) of the edge of the resonator on the front side. FIG. 4(*c*) shows the cross sectional view of the circuit in a microstrip version.

FIG. 5(*a*) shows the front view of the invented filter circuit with two round shaped high temperature superconductor resonators. FIG. 5(*b*) shows the back view of the invented filter circuit with back-side coupling circuits and a projection (dashed lines) of the edges of the resonator on the front side. FIG. 5(*c*) shows the cross sectional view of the circuit in a microstrip version.

FIG. 6(*a*) shows the front view of the invented filter circuit having a round shaped high temperature superconductor resonator with a notch at a 45-degree angle relative to the horizontal and vertical axes of the resonator plane. FIG. 6(*b*) shows the back view of the invented filter with back-side coupling circuits and a projection (dashed lines) of the edges of the resonators on the front side. FIG. 6(*c*) shows the cross sectional view of the circuit in a microstrip version.

FIG. 7(*a*) shows the front view with two square shaped high temperature superconductor resonators. FIG. 7(*b*) shows the back view with back side coupling circuits, a metallic layer, and metallic contact points. FIG. 7(*c*) shows the cross sectional view of the circuit.

FIG. 8(*a*) shows the front view. FIG. 8(*b*) shows the cross sectional view of the case.

FIG. 9(*a*) shows a graph of the amplitude of the measured $S_{11}$ (reflecting response for a first port) versus frequency, at a power level of 0.2 W. FIG. 9(*b*) shows a graph of the amplitude of the measured $S_{22}$ (reflecting response for a second port) versus frequency at a power level of 0.2 W. FIG. 9(*c*) shows a graph of the amplitude of the measured $S_{21}$ (transmitting response) versus frequency at a power level of 0.2 W. FIG. 9(*d*) shows a graph of the amplitude of the measured $S_{21}$ (transmitting response) versus frequency at different power levels of 0.2 W, 7.3 W, 8.7 W, and 10 W for comparison.

FIG. 10(*a*) shows the front view for both versions having square shaped high temperature superconductor resonators. FIG. 10(*b*) shows the back view of one version with coupling partially on the back side. FIG. 10(*c*) shows the back view of other version with the coupling circuit totally on the back side. FIG. 10(*d*) shows the cross sectional view for both versions.

DETAILED DESCRIPTION OF THE INVENTION

This invention comprises an improved high temperature superconductor filter with back-side coupling. Coupling is defined as the electromagnetic link between separate parts of a high temperature superconductor filter circuit. The coupling in a planar high temperature superconductor filter can be divided into two categories: (1) The input/output couplings, which provide linkage between the input and output ports to the associated resonators, and (2) the intersectional or interconnecting couplings, which provide linkage between two or more separate resonators. The back-side coupling of the present invention is applicable to both the input/output and the intersectional couplings.

Figure 1A:
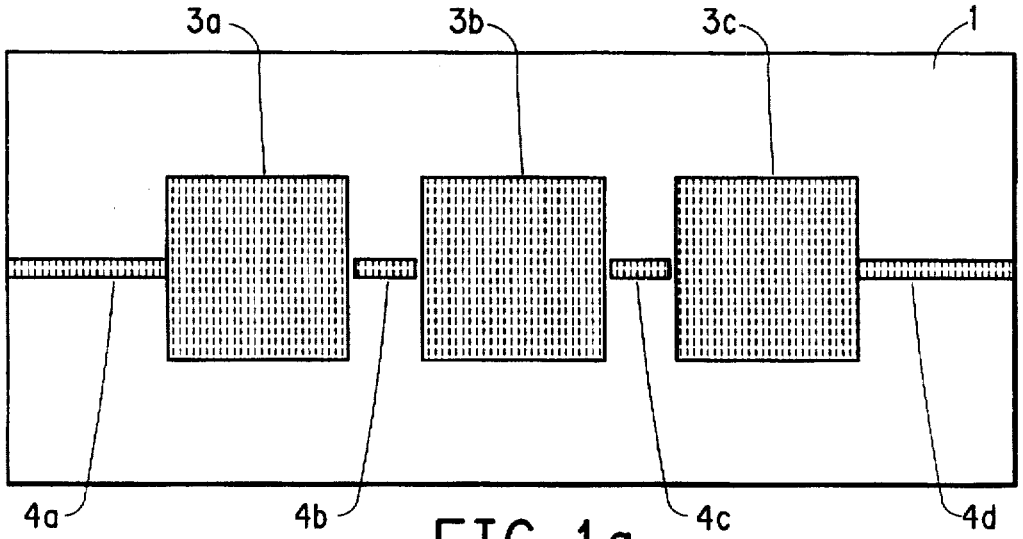
FIG. 1a (PRIOR ART)
FIG. 1 shows a conventional prior art 3-pole single mode high temperature superconductor filter with front-side coupling, as described in Applied Microwave Magazine, Fall 1991, pages 86–93.
Figure 1B:
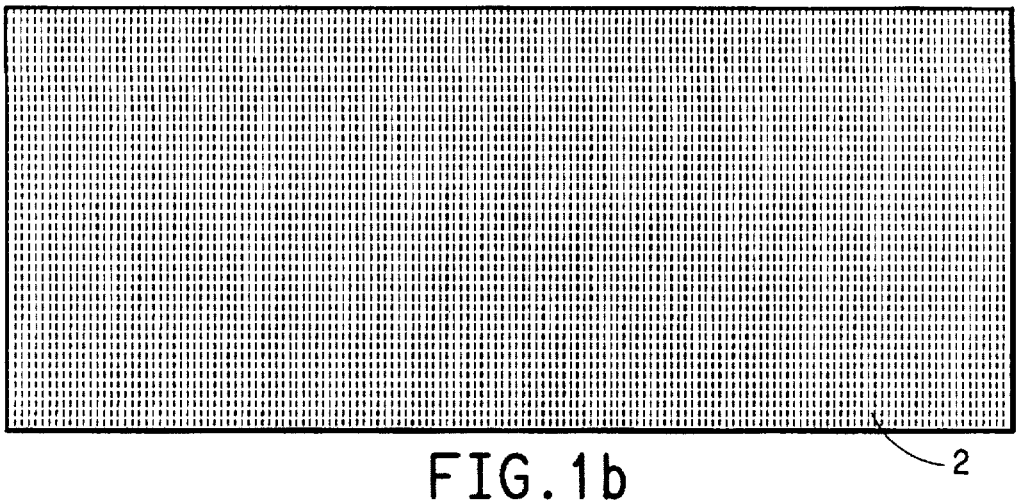
FIG. 1b (PRIOR ART)
Figure 1C:
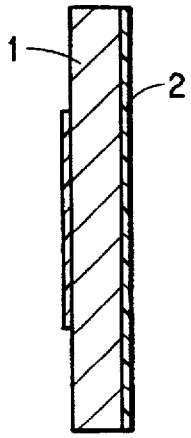
FIG. 1c (PRIOR ART)
Figure 2A:
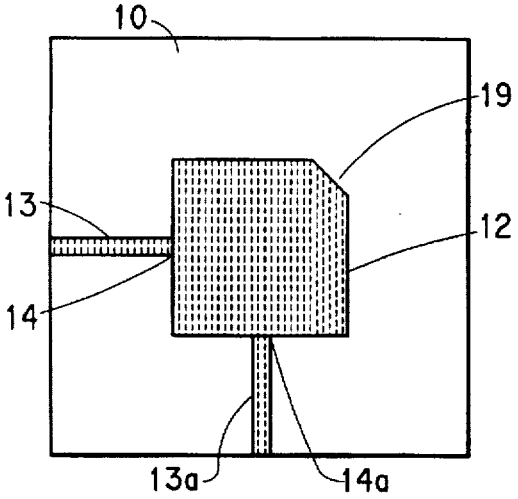
FIG.2a (PRIOR ART)
FIG. 2 shows a conventional prior art 2-pole dual mode high temperature superconductor filter, as described in Applied Microwave Magazine, Fall 1991, pages 86–93, with three known front-side coupling configurations.
Figure 2B:
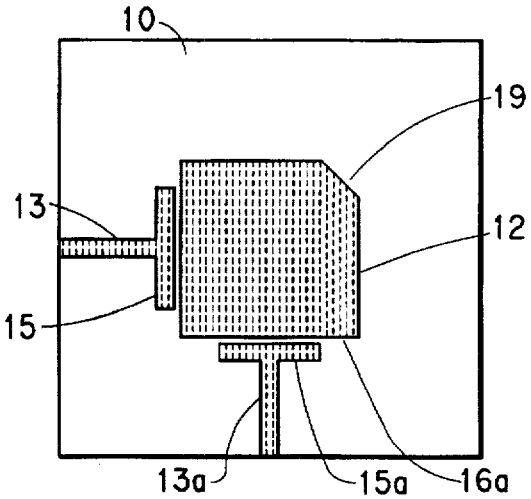
FIG.2b (PRIOR ART)
Figure 2C:
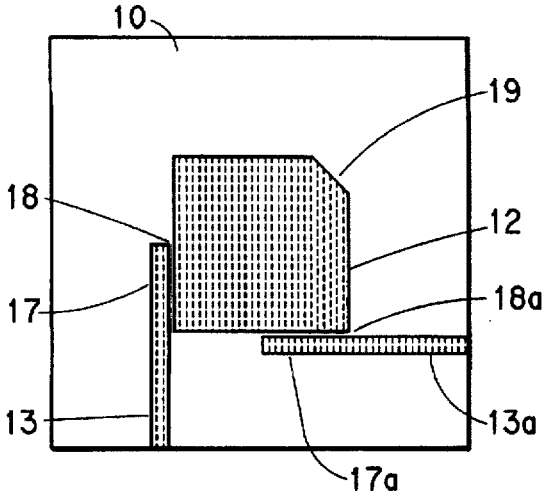
FIG.2c (PRIOR ART)
Figure 2D:
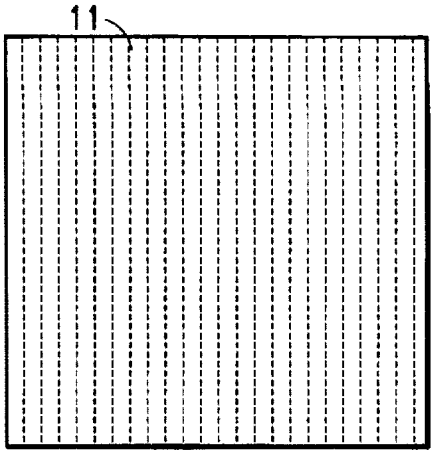
FIG.2d (PRIOR ART)
Figure 2E:
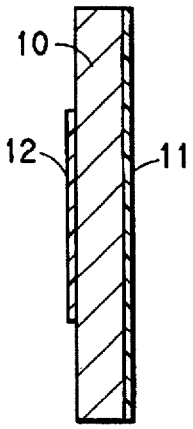
FIG.2e (PRIOR ART)

All known high temperature superconductor filter coupling apparatus utilize front-side coupling, which means that the coupling circuits, and the resonant circuits are patterned on the same side (the front side) of the substrate and the back-side is an unpatterned high temperature superconductor ground plane as shown in FIG. 1(*b*) and FIG. 2(*d*).

The back-side coupling of the present invention places the high temperature superconductor coupling circuits totally or partially on the substrate side opposite to the high temperature superconductor resonators, i.e., the back-side of the substrate. In other words, the back-side coupled high temperature superconductor filters of the present invention have patterned high temperature superconductor circuits on both sides of the substrates.

Since the back-side also serves as the ground plane of the high temperature superconductor filter, the transmission line used to form the back-side coupling is in the coplanar line configuration. The coplanar line configuration provides several advantages for the coupling circuit: First, the center line and the ground plane of the coplanar line are on the same surface, which is ideal for back-side coupling. Second, the center line width of the coplanar line can be increased to handle higher power, while at the same time maintaining a given characteristic impedance such as 50-ohm. Use of a wider width results in a requirement for less strict manufacturing tolerances and easier design and fabrication. Also back side coupling eliminates arcing across the gap when gap or parallel line coupling are used because no gap exists on the other side of the substrate. The gap is the thickness of the substrate, since the coupling lines are on the opposite side of the substrate than the resonators.

The main concept of back-side coupling is to couple the resonators from their back-sides through openings in the ground plane on the back side of the substrate and to use coplanar lines to transmit the radiofrequency power to the vicinity of the resonator. The coupling mechanism is the overlapping of the electromagnetic fields associated with the resonators and with the coupling circuits. In order to increase power handling capability, it is preferable to arrange the overlapping electromagnetic field in a large region. To do so, the coupling circuit may have a different size and shape, such as branched coplanar lines with different lengths and angles, with respect to the main coplanar line, and a gradually changing center line width.

The back-side coupling spreads the overlapping electromagnetic fields in a large region, which not only reduces the radiofrequency current density in the high temperature superconductor circuits resulting in a higher power handling capability, but also makes the coupling strength less dependent upon the variation of the circuit dimensions. This results in a much less strict manufacturing tolerance requirement for placement of the filter components (at least an order of magnitude compared to the front-side coupling), which greatly eases the required tolerances for the coupling circuits.

This invention further comprises combinations of front-side and back-side coupling in a high temperature superconductor filter, in which part of the coupling circuit is on the front-side, and the other part is on the back-side.

The back-side coupling concept and circuits of the present invention can also be used for forming high temperature superconductor filter banks and multiplexers. In those cases, coplanar lines on the back-side are used for providing an input connecting network, an output connecting network and intrachannel network coupling between the filters in the multiplexer. In addition, the individual filters within a multiplexer can employ back side coupling. Because the interconnection network transmission lines handle the sum of the power of all individual filters, the high power handling capability of coplanar line with broader line width is more important for filter banks and multiplexers than for a single filter.

The high temperature superconductor thin film materials useful in the practice of this invention can include any superconductor with a $T_c$ greater than 77° K. Preferably the material is selected from $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)Sr_2Ca_2Cu_3O_9$. The substrate materials can be any dielectric material with close lattice match to the high temperature superconductor thin film deposited thereon and having a loss tangent of less than 0.0001. The substrate materials are commonly selected from LaAlO3, MgO, LiNbO3, sapphire or quartz.

In the present invention the separate filter elements such as the resonators, and the input and output ports of a high temperature superconductor filter are coupled from the back-side, which is the ground plane of the filter circuit. The basic transmission line form for the back-side coupling is the coplanar line, in which the center line width can be chosen to satisfy the power handling requirement and at the same time to provide the required characteristic impedance. The coplanar line shares the ground plane with the resonator of the filter. As long as the above mentioned principles are followed, the configuration, shape, and the dimensions of a particular coupling circuit or its components, such as transmission lines or discontinuities around transmission lines, may vary. Some examples are given below.

Figure 3A:
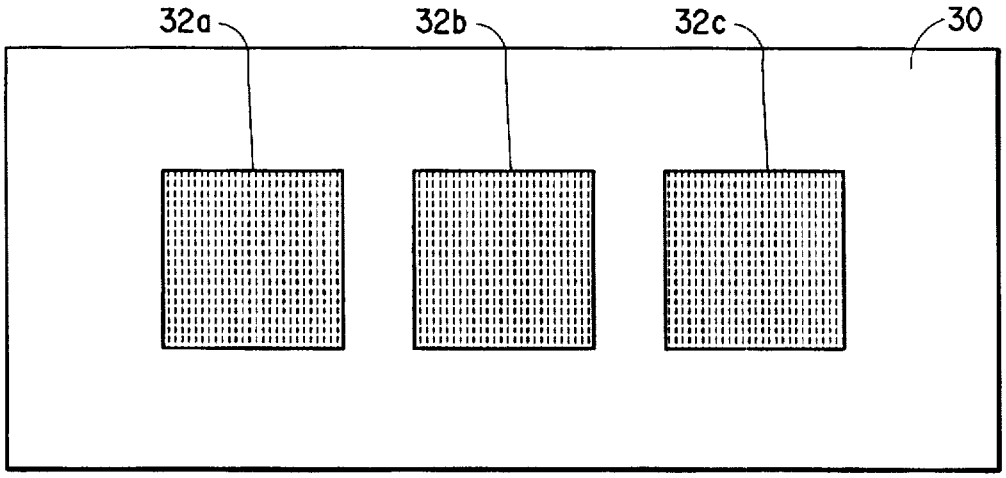
FIG. 3 shows a first embodiment of the present invention of a back-side coupled single mode 3-pole high temperature superconductor filter.
Figure 3B:
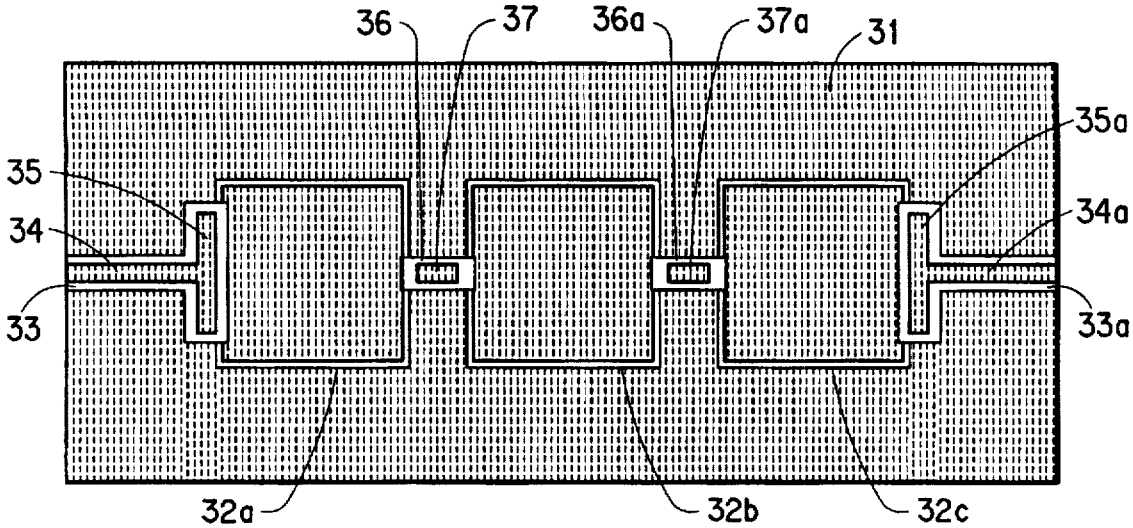
Figure 3C:
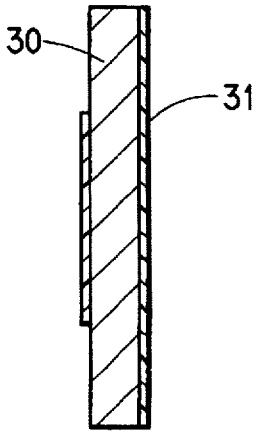

FIG. 3 shows one embodiment of the present invention as a single mode 3-pole square shaped high temperature superconductor filter. FIG. 3(*a*) shows the three square resonators, 32*a*, 32*b*, and 32*c*, located on the front-side of the substrate 30 having a discrete distance between them. FIG. 3(*c*) shows the cross section of the circuit. The back-side of substrate 30 is coated with high temperature superconductor film 31, as shown in FIG. 3(*c*). The back-side coupling circuits are shown in planar with the high temperature superconductor film 31 FIG. 3(*b*). The coupling circuit comprises two branched high temperature superconductor transmission lines in coplanar line form and interconnecting transmission lines between the resonators in coplanar line form. In FIG. 3(*b*), center transmission lines 34 and 34*a* along with the spacing 33 and 33*a*, each a discontinuity in the film of the ground plane around the perimeter of the transmission line, form the input and output coplanar lines. One end (at the edge of the substrate) of each of center line 34 and 34*a* is connected to the input or output port (not shown). The other end of each of 34 and 34*a* is extended to form a T-shaped branch comprising branched transmission lines 35 and 35*a*. The purpose of the said T-shape branches is to spread the electromagnetic fields along a projection of the vertical side of resonators 32*a* and 32*c*, respectively, as shown by the dashed lines in FIG. 3(*b*). The dashed lines are a projection of the outline or outer edge of the resonators and represent their electromagnetic fields since the resonators are located on the front-side of the substrate as shown in FIG. 3(*a*). The back-side intersectional coupling is also achieved by coplanar lines formed by the center lines 37 and 37*a* and discontinuities 36 and 36*a* in the film of the ground plane. The coupling strength can be adjusted by varying the dimensions and the locations of 33, 33*a*, 34, 34*a*, 35, 35*a*, 36, 36*a*, 37, and 37*a*. To maximize coupling strength the discontinuities 33, 33*a*, 36 and 36*a* are adjacent to or overlap the projection of the resonator edges to provide overlap of the electromagnetic fields of the coupling circuit and the resonators. In this particular case, the square high temperature superconductor resonators, 32*a*, 32*b*, and 32*c* are single mode with the radiofrequency current along the horizontal direction in FIG. 3(*a*). The other mode with the radiofrequency current along the vertical direction is not used. However, any parasitic coupling can couple to the vertical mode, which causes interference. To avoid such interference, the high temperature superconductor resonator can be designed in a rectangular shape to shift the resonant frequency of the vertical mode off the passing band (the desired bandwidth).

Figure 4A:
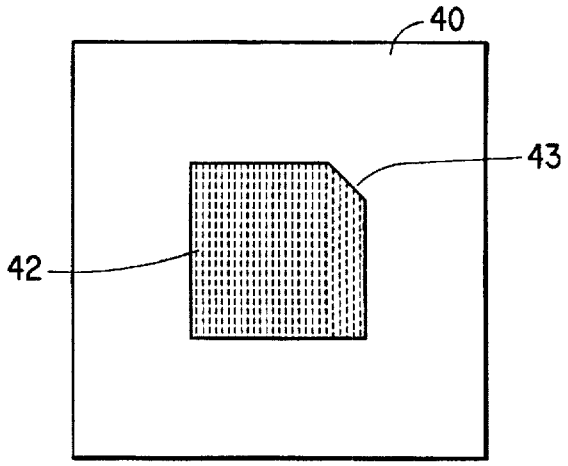
FIG. 4 shows a second embodiment of the present invention of a back-side coupled dual mode 2-pole high temperature superconductor filter.
Figure 4B:
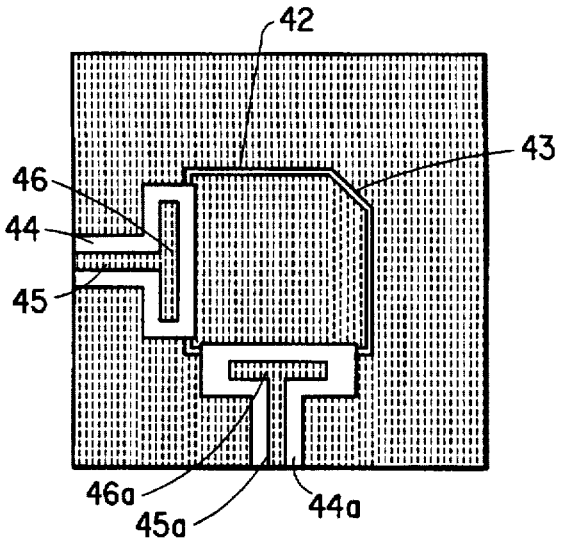
Figure 4C:
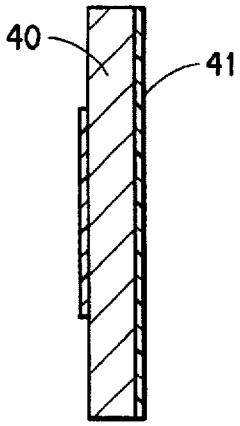

FIG. 4 shows another embodiment of the back-side coupled high temperature superconductor filter of the present invention. It is a dual mode 2-pole filter. FIG. 4(*a*) shows the front side, in which the high temperature superconductor cut-corner square resonator 42 having a cut-corner 43 is deposited on the front side of substrate 40. As shown in FIG. 4(*c*), a cross sectional view of the filter, the back side of substrate 40 is coated with high temperature superconductor film 41, which serves as the ground plane of the resonator. The back-side coupling circuits are shown in FIG. 4(*b*) and comprise two branched high temperature superconductor transmission lines. The coupling circuits include: input and output center lines 45 and 45*a*; discontinuities 44 and 44*a* in the film 41 of the ground plane, and extended branch center lines 46 and 46*a*, as seen in FIG. 4(*b*). All coupling circuits are in the coplanar line configuration. There are two modes in the dual mode resonator 42: one with horizontal radiofrequency current, the other with vertical current. The intersectional coupling in this particular case is provided by the cut-corner 43. The location of a projection of the outer edge of resonator 42 and the cut-corner 43 are indicated by the dashed lines in FIG. 4(*b*). Again, the coupling strength of the back-side coupling can be adjusted by varying the location, the shape, and the dimensions of the coupling circuit elements, 44, 44*a*, 45, 45*a*, 46 and 46*a*. To maximize coupling strength the discontinuities 44 and 44*a* are adjacent to or overlap with the projection of the resonator edges to provide overlap of the electromagnetic fields of the coupling circuit and the resonator.

Figure 5A:
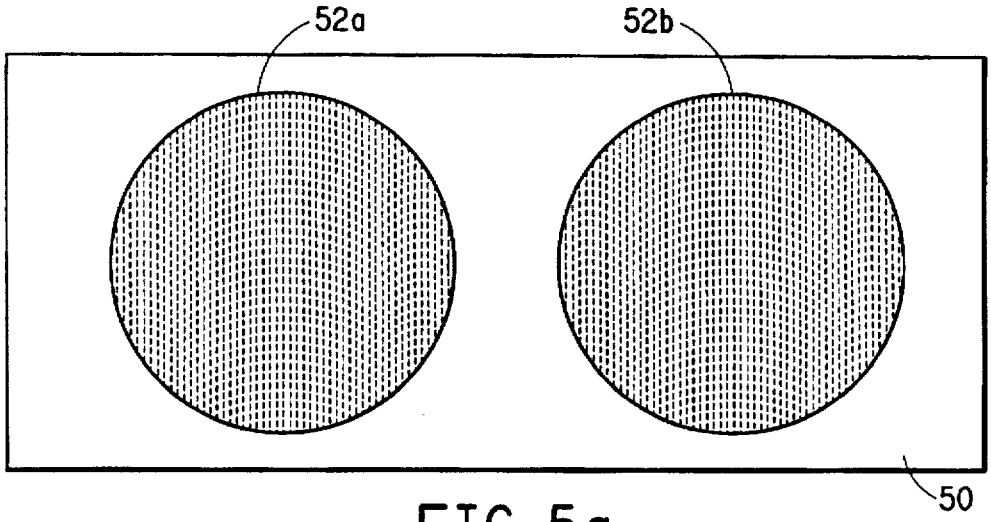
FIG. 5 shows a third embodiment of the present invention of a back-side coupled single mode 2-pole high temperature superconductor filter.
Figure 5B:
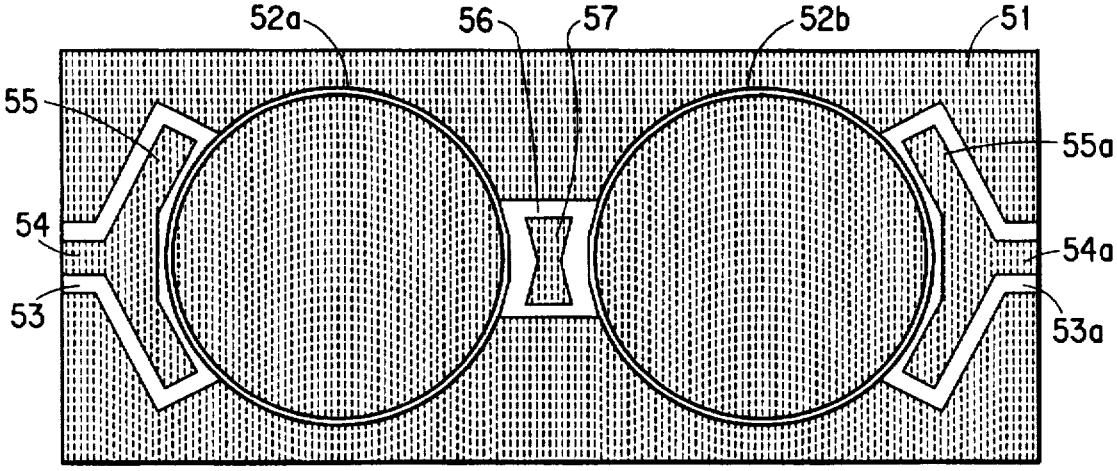
Figure 5C:
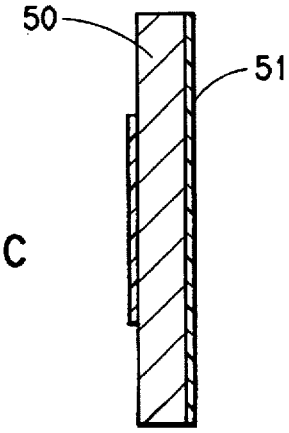

FIG. 5 shows yet another embodiment of the back-side coupled high temperature superconductor filter of the present invention. In this particular case, it is a single mode round shaped 2-pole high temperature superconductor filter with two resonators 52*a* and 52*b*, deposited on the front side of the substrate 50 as shown in FIG. 5(*a*). As shown in FIG. 5(*b*), the back-side of the substrate is coated with high temperature superconductor film 51, which serves as the ground plane of the filter and has the patterned coupling circuits. The input and output coupling circuits are branched transmission lines in the coplanar configuration including the following parts: the center lines 54 and 54*a*; the discontinuities (in the film of the ground plane) 53 and 53*a*; and the extended branch center lines 55 and 55*a*. Note that, in this particular case, the branched lines 55 and 55*a*, are not straight lines but instead they are in a V-shape which is closer to the projection of the outer edges of the round shaped resonators 52*a* and 52*b*. Overlap of the electromagnetic fields of the resonators and coupling circuit provide a stronger coupling. The interconnecting coupling is also in the coplanar line configuration including the center line 57 and the discontinuity 56 in the film of the ground plane. The projection of the resonators shape or outer edges is indicated by the dashed lines in FIG. 5(*b*). FIG. 5(*c*) shows the cross-sectional view of the high temperature superconductor filter circuit showing high temperature superconductor film 51 coating the back side of substrate 50.

At certain frequencies, the round shaped resonators also support dual modes similar to those in the square resonator. The single mode filter such as shown in FIG. 5 utilizes only the mode with horizontal current because the possible parasitic coupling to the mode with vertical current also causes undesired interference. Such interference can be avoided by using elliptical shaped resonators to replace the round shaped ones to shift the resonant frequency of the interference mode off the passing band.

Figure 6A:
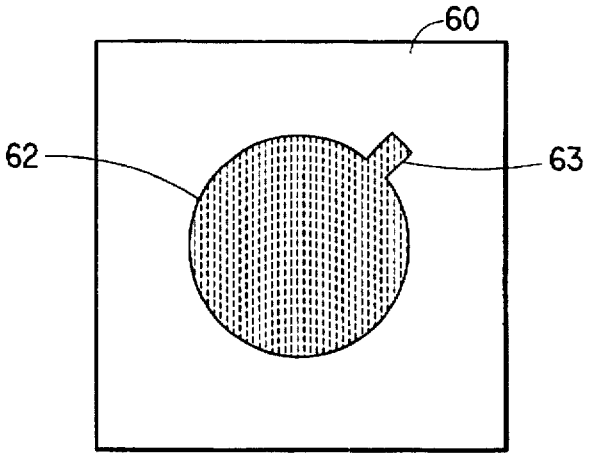
FIG. 6 shows a fourth embodiment of the present invention of a back-side coupled dual mode 2-pole high temperature superconductor filter.
Figure 6B:
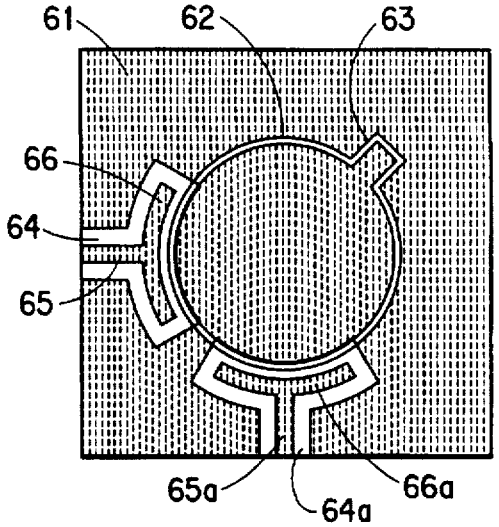
Figure 6C:
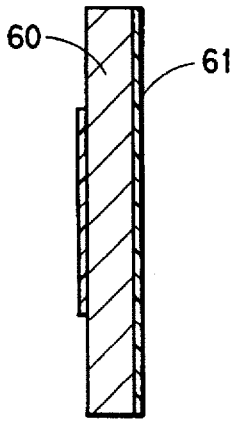

FIG. 6 shows yet another embodiment of the back-side coupled high temperature superconductor filter of the present invention. In this particular case, it is a dual mode round shaped 2-pole high temperature superconductor filter. FIG. 6(*a*) shows the front view of the filter circuit, in which a round shaped high temperature superconductor resonator 62 having a stub 63 located at a 45-degree angle relative to the vertical and the horizontal axes of the resonator plane is deposited on the surface of the substrate 60. The back-side of substrate 60 is coated with high temperature superconductor thin film 61 serving as the ground plane of the filter as shown in the cross-sectional view of the filter in FIG. 6(*c*). The back-side coupling circuits are shown in FIG. 6(*b*). The back-side coupling circuits are branched transmission lines in the coplanar configuration including the following parts: the center lines 65 and 65*a*; the discontinuities 64 and 64*a* in the film 61 of the ground plane; and the extended branch center lines 66 and 66*a*, as seen in FIG. 6(*b*). The projection of the outer edges of the resonator 62 with stub 63 is indicated by the dashed lines in FIG. 6(*b*). In this particular case, the branched lines 66 and 66*a*, are in a curved shape which is closer to the projected edges of the round resonator, 62, to provide a stronger coupling. Again, the coupling strength can be adjusted by varying the location, shape, and the dimensions of the coupling circuit elements 65, 65*a*, 64, 64*a*, 66 and 66*a*.

Figure 7A:
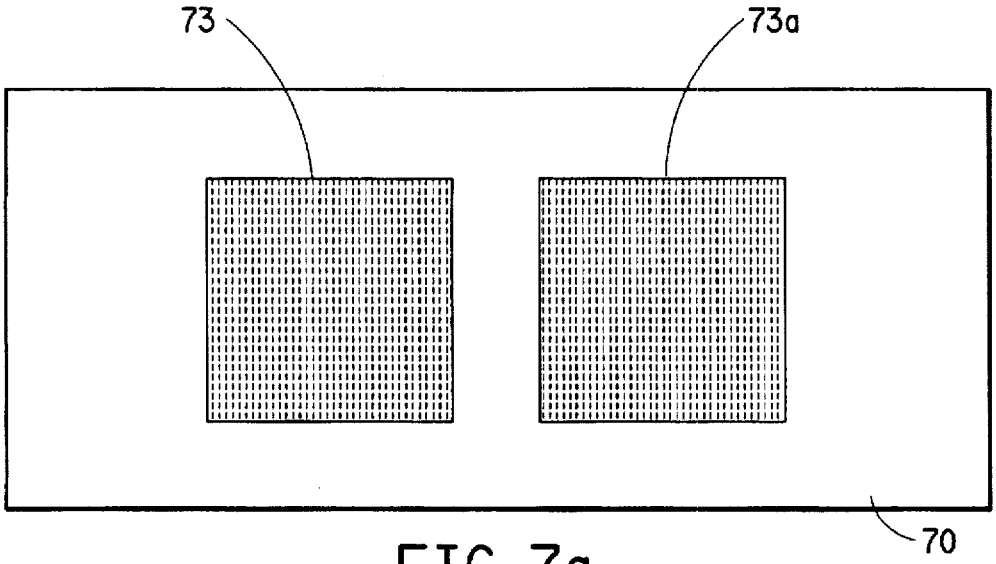
FIG. 7 shows the layout of a back-side coupled single mode 2-pole high temperature superconductor filter circuit of the present invention.
Figure 7B:
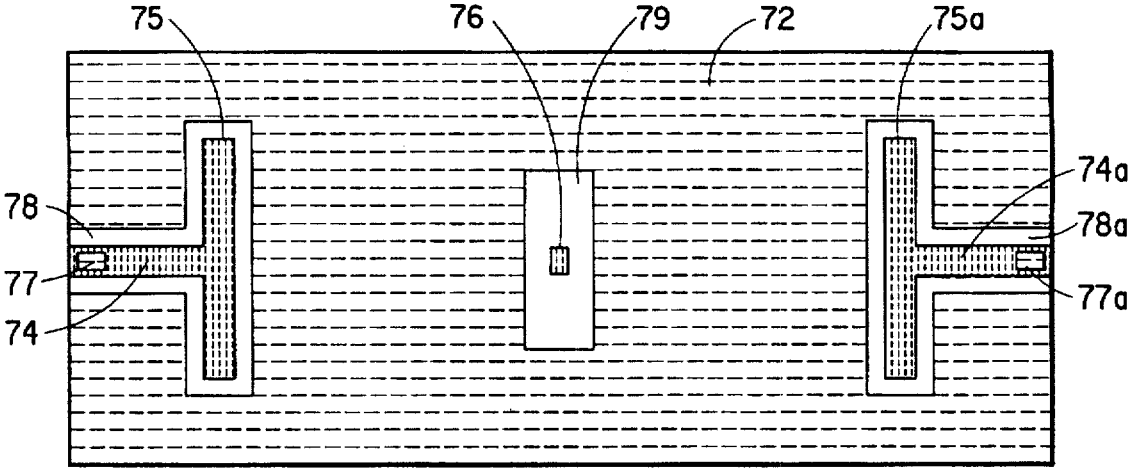
Figure 7C:
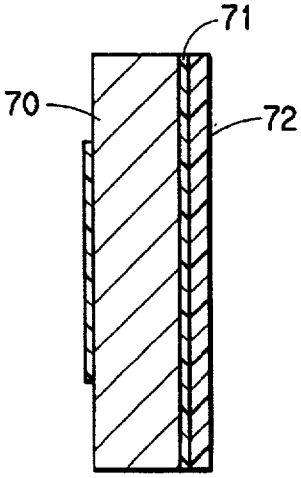

FIG. 7 shows the layout of an L-band single mode 2-pole high temperature superconductor filter of the present invention with back-side coupling circuits. FIG. 7(*a*) shows the front view, in which two high temperature superconductor square resonators 73 and 73*a* are deposited on the front-side of the substrate 70. The back-side of substrate 70 is coated with high temperature superconductor film 71 and a metallic thin film 72 as shown in the cross-sectional view in FIG. 7(*c*). FIG. 7(*b*) shows the back view of the filter, in which the back-side coupling circuit comprising two branched transmission lines and an interconnecting transmission line are shown. The input and output coupling circuits include the following parts: center lines 74 and 74*a*; discontinuities 78 and 78*a* in the film of the ground plane; and extended branch lines 75 and 75*a*. The intersectional coupling circuit includes the center line 76 and the discontinuity 79 in the film of the ground plane. A metallic thin film 72, such as gold or silver, is deposited on top of a portion of the high temperature superconductor ground plane 71. The metallic film 72 has openings through which the elements of the coupling circuit are exposed, including elements 74, 74*a*, 75, 75*a*, 76, 78, 78*a* and 79. Metallic contacts 77 and 77*a* are deposited on the transmission lines 74 and 74*a* for bonding to the input and output connectors (not shown). The purpose of the metallic film 72 on top of the high temperature superconductor film 71 is for soldering the filter to an outer enclosure case (not shown).

Figure 8A:
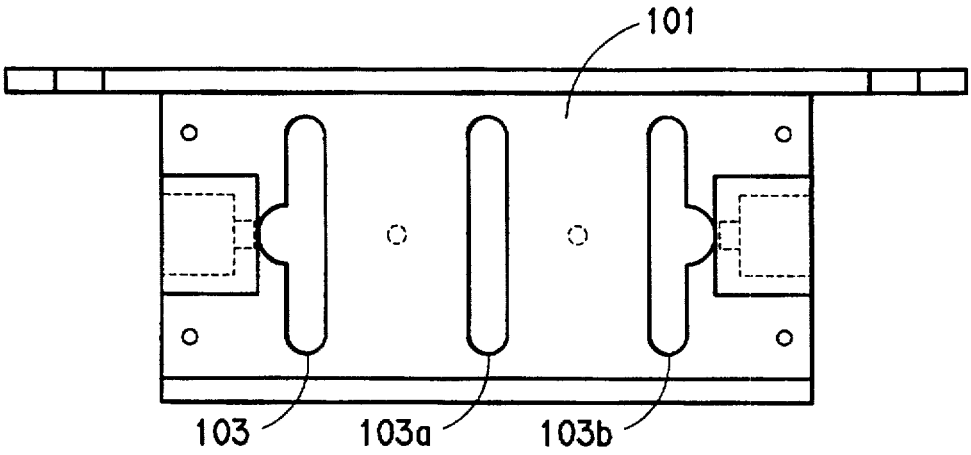
FIG. 8 shows a metallic case for housing the back-side coupled high temperature superconductor filter of the present invention shown in FIG. 7.
Figure 8B:
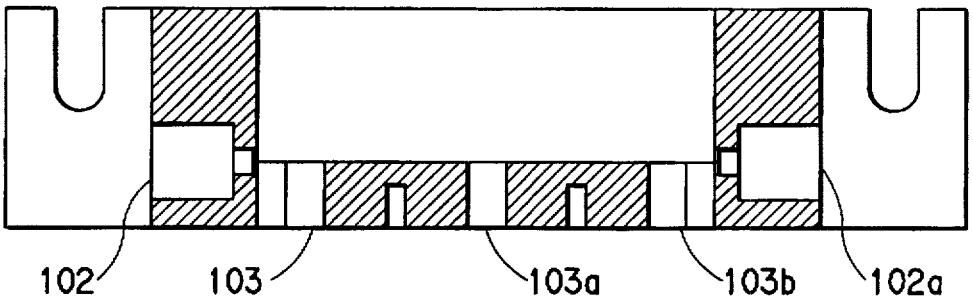
Figure 9A:
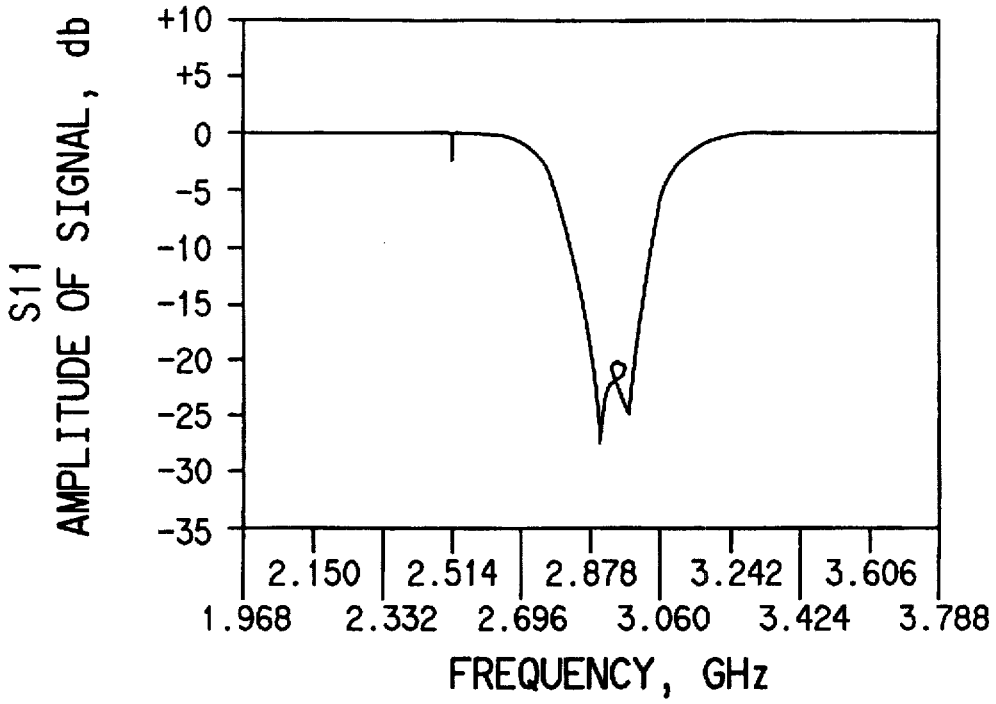
FIG. 9 shows the measured performance of the invented back-side coupled high temperature superconductor filter shown in FIG. 7.
Figure 9B:
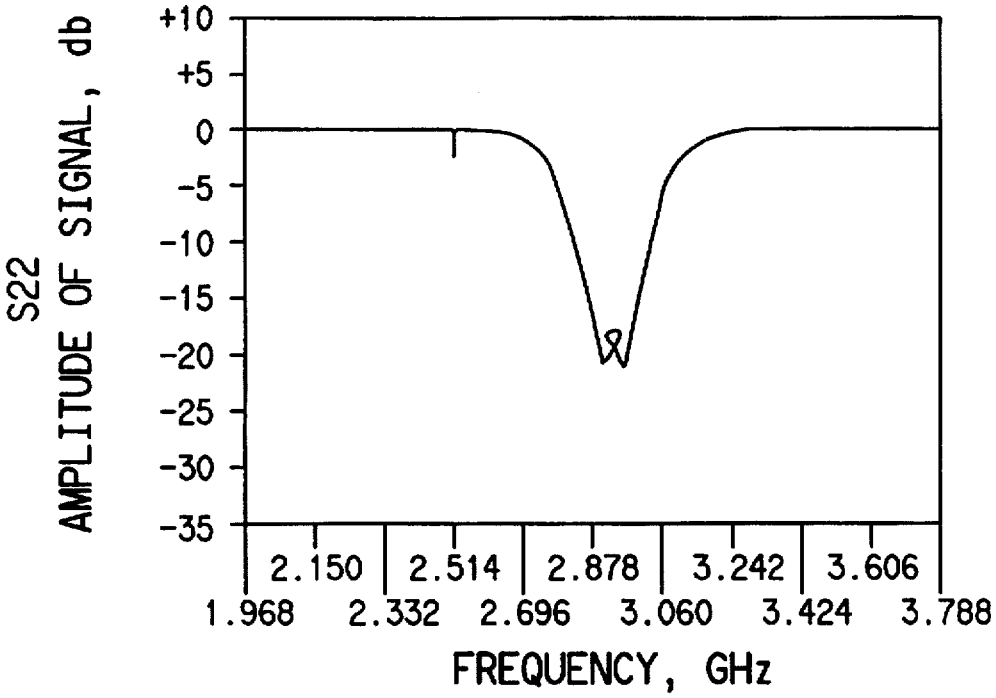
Figure 9C:
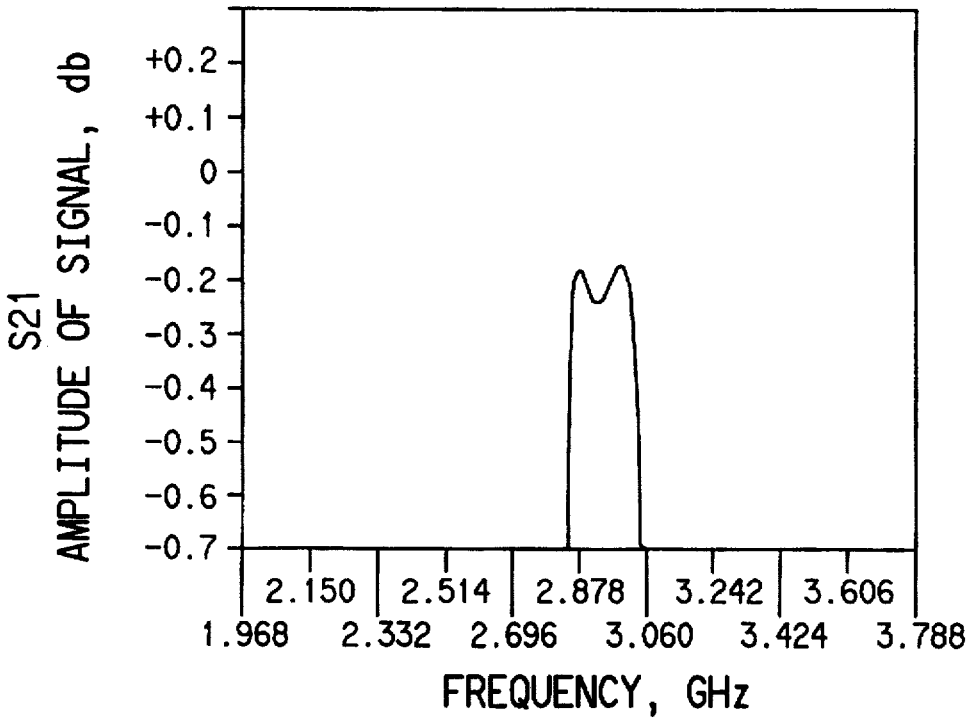
Figure 9D:
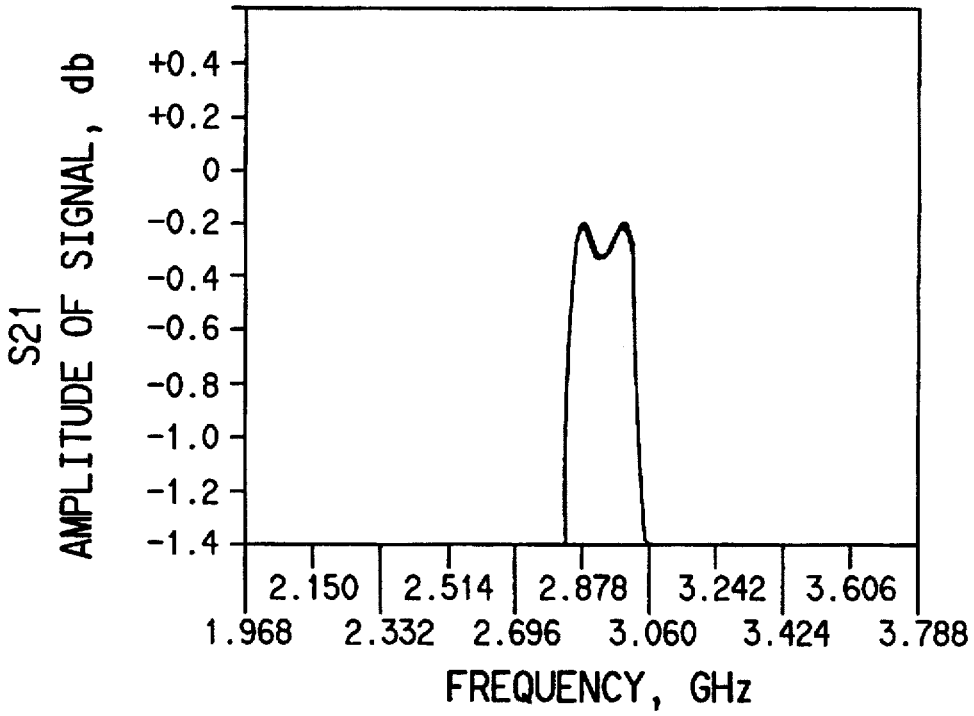
Figure 10A:
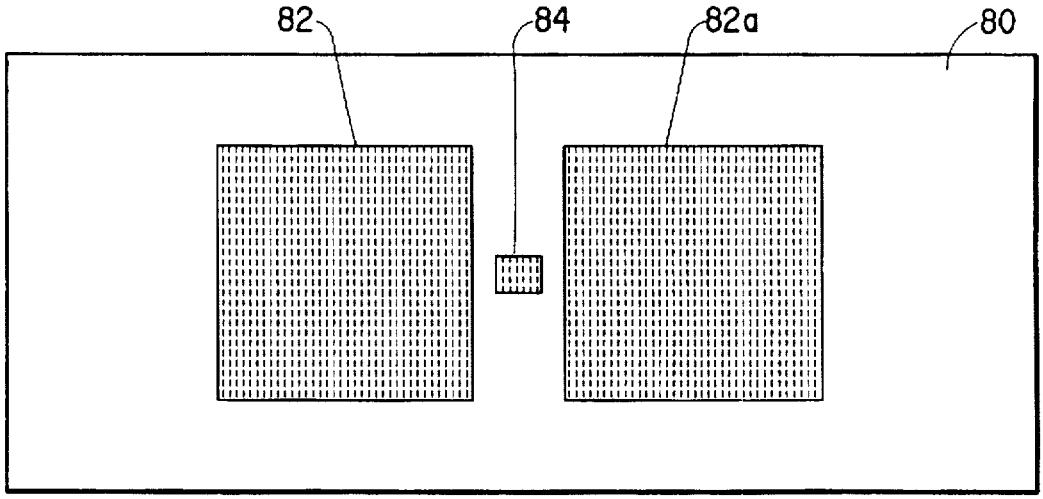
FIG. 10 shows a single mode 2-pole high temperature superconductor filter of the present invention with two versions of hybrid coupling circuits.
Figure 10B:
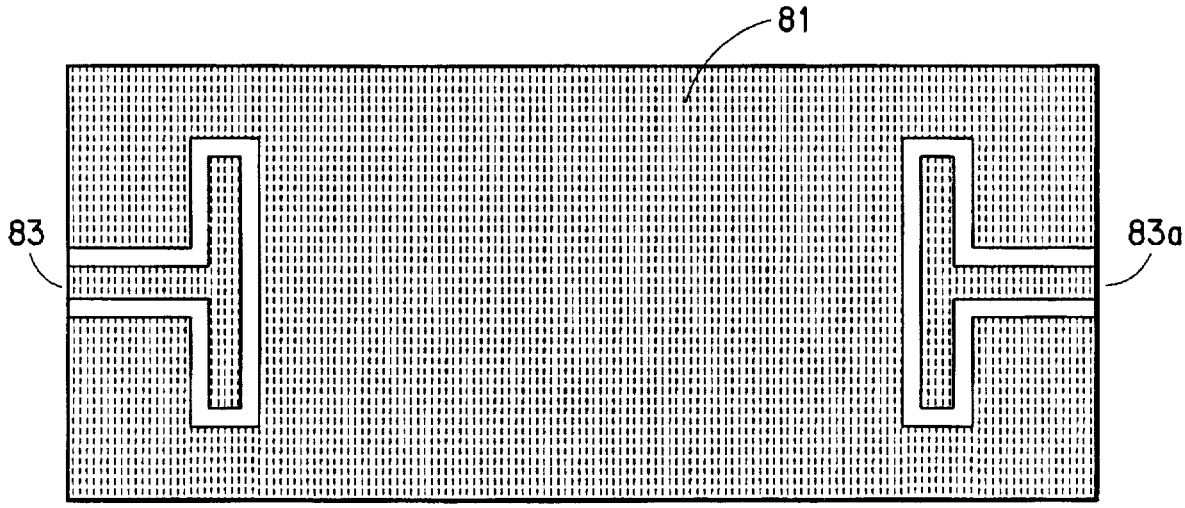
Figure 10C:
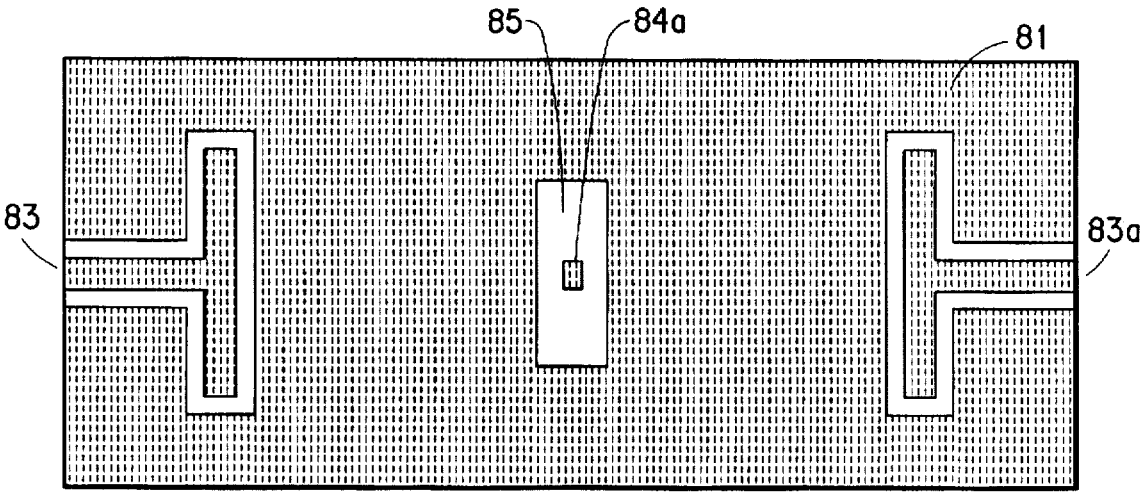
Figure 10D:
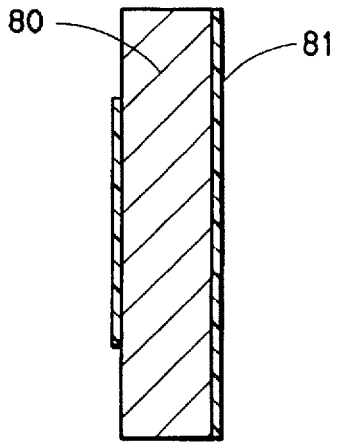

FIG. 3 shows a metallic outer enclosure case for housing the filter shown in FIG. 7. FIG. 8(*a*) shows the front view of the case, in which 101 is the case body with three cut-through openings, 103, 103*a* and 103*b*. These cut-through openings are aligned to accomodate exposure of the back-side coupling circuit shown in FIG. 7(*b*). The openings have a similar shape and slightly larger dimensions than the corresponding discontinuities in the ground plane of the filter circuit. FIG. 8(*b*) shows the cross sectional view of the case. Holes 102 and 102*a* are for the input and output connectors, which are not shown in the figure. Openings 103, 103*a* and 103*b* are shown in cross section.

FIG. 9 depicts graphs showing the measured performance of the high temperature superconductor filter shown in FIG. 7. FIG. 9(*a*), FIG. 9(*b*), and FIG. 9(*c*) each show a graph of the amplitude of the measured $S_{11}$, $S_{22}$, and $S_{21}$, respectively, as functions of frequency at a low power level of 0.2 W. $S_{11}$ is the reflecting response for a first port. $S_{22}$ is the reflecting response for a second port. $S_{21}$ is the transmitting response. FIG. 9(*d*) shows a graph of the amplitude of the measured $S_{21}$ versus frequency at different power levels of 0.2 W, 7.3 W, 8.7 W and 10 W. The measured data show that the performance of the high temperature superconductor filter virtually does not change up to 10 watts, which indicates a significant power handling capability for such a compact planar high temperature superconductor filter. In fact, the 10 watts power level is limited by the enclosure case's thermal efficiency at the input interface and the power limit of the testing setup. The real power handling capability is believed to be even higher. Additional test data shows that this filter handles 22 watts at 77K.

The back-side coupling circuits of the present invention can also be used for high temperature superconductor filter banks and multiplexers. A filter bank or a multiplexer comprises a series of filters in parallel with connecting network lines to link them. The back-side coupling circuits of the present invention not only can be used in high temperature superconductor filters but also can be used for interconnection among these filters.

This invention also includes filters, having a hybrid form of simultaneous back-side and front-side couplings, in which part of the coupling circuit or network is located on the front side, i.e., the same side of the substrate as the resonators, and the other part of the coupling circuit or network is located on the back-side, i.e., the side opposite of the resonator. FIG. 10 shows two examples. FIG. 10(*a*) shows the front view of a single mode 2-pole high temperature superconductor filter with 2 square high temperature superconductor resonators 82 and 82*a*, deposited on the front-side of the substrate 80. The back-side of substrate 80 is coated with high temperature superconductor film 81 as the ground plane as shown in the cross sectional view FIG. 10 (*d*). The filter has back-side T-shaped coplanar transmission lines 83 and 83*a*, for the input, and the output, respectively, in the film 81 as shown in FIGS. 10(*b*) and 10(*c*).

But the interconnecting coupling between resonators has two possible versions: The first version is a front-side coupling as shown in FIG. 10(*a*) in which the interconnecting transmission line 84 is on the front-side of the substrate. No interconnecting transmission line is on the back-side. See FIG. 10(*b*). In this version, the hybrid coupling means a combination of the back-side branched transmission lines for coupling to the input and output and a front side interconnecting transmission line for coupling between resonators. The second version is a hybrid coupling in which the interconnecting transmission line for coupling between resonators has both a front side element 84 as shown in FIG. 10(*a*), and back-side elements center line 84*a* and discontinuity 85 as shown in FIG. 10(*c*). The input T-shaped coplanar transmission line 83 and the output T-shaped coplanar transmission line 83*a* are also seen in FIG. 10(*c*). In this version, the hybrid coupling means a combination of back-side and front-side interconnecting transmission lines for coupling between resonators. The hybrid coupling circuits of the present invention include any planar high temperature superconductor filters, filter banks, or multiplexers containing a combination of back-side and front side coupling circuits and/or connecting networks in the coplanar line configuration.

The filters of the present invention are useful in microwave communication satellites, and in electronic systems for selecting and channeling radiofrequency signals, in particular in telecommunications systems.

What is claimed is:

1. A high temperature superconducting planar filter comprising:

a) a single planar substrate having a front side and a back side, b) at least two planar resonators disposed in spaced-apart, coplanar relation to one another on the front side of the substrate, each resonator comprising a respective high temperature superconducting film pattern, c) a planar ground plane comprising a high temperature superconducting film disposed of the back side of the substrate, and d) a coupling circuit comprising a coplanar waveguide input line electrically isolated from the ground plane and electromagnetically coupled to one of the at least two resonators, a coplanar waveguide output line electrically isolated from the ground plane and electromagnetically coupled to another one of the at least two resonators, and coplanar waveguide interconnecting lines electrically isolated from the ground plane and respectively electromagnetically coupled between adjacent ones of the at least two resonators; wherein at least a portion of the coupling circuit is disposed on the back side of the substrate and coplanar with the ground plane.

2. The filter of claim 1 wherein the coupling circuit comprises:

a) a first planar branched high temperature superconductor transmission line connected to the coplanar waveguide input line, b) a second planar branched high temperature superconductor transmission line connected to the coplanar waveguide output line, wherein at least one of the first branched transmission line, the second branched transmission line and the interconnecting transmission line is located on the back side of the substrate, wherein a respective discontinuity exists in the high temperature superconductor film of the ground plane to electrically isolate each corresponding transmission line which is located on the back side of the substrate from the ground plane, wherein upon application of a signal to the filter, corresponding electromagnetic signals are generated in each respective resonator and corresponding electromagnetic fields are generated in each of the respective first branched transmission line, the second branched transmission line and the interconnecting transmission line corresponding to each said respective resonator, wherein the respective electromagnetic fields generated by each respective first transmission line and the second transmission line overlap with the respective electromagnetic signal generated by the corresponding resonator, and wherein the respective electromagnetic fields generated by the respective interconnecting transmission line overlaps with the electromagnetic signals generated by the corresponding resonators.

3. The filter of claim 2 wherein the first branched transmission line the second branched transmission line and the interconnecting transmission line are all located on the back side of the substrate.

4. The filter of claim 3 further comprising a) a metal film pattern disposed on the ground plane, said metal film having openings corresponding to each of said first and second branched high temperature superconductor transmission lines and said interconnecting transmission line, and b) a metal contact point disposed on each of said first and second branched transmission lines.

5. The filter of claim 2 wherein each of said first and second branched transmission lines are respectively configured to conform to a shape of a portion of the outer edge of the corresponding resonator.

6. The filter of claim 1 wherein the substrate is a dielectric material lattice matched to the respective high temperature superconductor film pattern disposed thereon and has a loss tangent of less than 0.0001.

7. The filter of claim 6 wherein the substrate is selected from the group consisting of $LaAlO_3$, MgO, $LiNbO_3$, sapphire or quartz.

8. The filter of claim 1 wherein each of the at least two resonators and the ground plane comprise a respective superconductor having a $T_c$ greater than about 77° K.

9. The filter of claim 8 wherein the respective superconductor is selected from the group consisting of $YBa_2Cu_3O_7$, $Tl_2Ba_2CaCu_2O_8$, $TlBa_2Ca_2Cu_3O_9$(TlPb)$Sr_2CaCu_2O_7$ and (TlPb)$Sr_2Ca_2Cu_3O_9$.

10. A high temperature superconducting planar filter comprising:

a) a substrate having a front side and a back side, b) at least two resonators, each resonator comprising a respective high temperature superconducting film pattern disposed on the front side of the substrate, c) a ground plane comprising a high temperature superconducting film disposed on the back side of the substrate, and d) a coupling circuit comprising 1) a first planar branched high temperature superconductor transmission line connected to a coplanar waveguide input line, 2) a second planar branched high temperature superconductor transmission line connected to a coplanar waveguide output line, and 3) a respective planar interconnecting high temperature superconductor transmission line between adjacent ones of said at least two resonators, wherein at least one of the first branched transmission line, the second branched transmission line and the interconnecting transmission line is located on the back side of the substrate, wherein a respective discontinuity exists in the high temperature superconductor film of the ground plane to electrically isolate each corresponding transmission line which is located on the back side of the substrate from the ground plane, and wherein, upon application of a signal to the filter, corresponding electromagnetic signals are generated in each respective resonator and corresponding electromagnetic fields are generated in each of the respective first branched transmission line, the second branched transmission line and the interconnecting transmission line corresponding to each said respective resonator, wherein the respective electromagnetic fields generated by each respective first transmission line and the second transmission line overlap with the respective electromagnetic signal generated by the corresponding resonator, and wherein the respective electromagnetic fields generated by the respective interconnecting transmission line overlaps with the electromagnetic signals generated by the corresponding resonators.

* * * * *